United States Patent [19]

Trancik

[11] 4,229,672

[45] Oct. 21, 1980

[54] SPARK PLUG WITH LOW EROSION ELECTRODE TIP

[75] Inventor: Edward R. Trancik, Highland Township, Oakland County, Mich.

[73] Assignee: Ford Motor Company, Dearborn, Mich.

[21] Appl. No.: 1,040

[22] Filed: Jan. 4, 1979

[51] Int. Cl.[3] ..... H01T 13/20; H01T 13/34

[52] U.S. Cl. ..... 313/139; 313/141; 313/144

[58] Field of Search ..... 313/139, 141, 144

[56] References Cited

U.S. PATENT DOCUMENTS

| | | | |
|---|---|---|---|
| 2,984,760 | 5/1961 | Bowlus et al. | 313/141 |
| 3,146,370 | 8/1964 | Van Duyne et al. | 313/136 X |
| 3,315,113 | 4/1967 | Lever | 313/136 |
| 3,407,326 | 10/1968 | Romine | 313/141 |
| 3,548,239 | 12/1970 | Eaton | 313/136 |
| 3,691,419 | 9/1972 | Van Uum et al. | 313/139 X |
| 3,868,530 | 2/1975 | Eaton et al. | 313/141 |

OTHER PUBLICATIONS

Publication Entitled "1966 Champion Ignition and Engine Performance Conference."

*Primary Examiner*—Palmer C. Demeo
*Attorney, Agent, or Firm*—Paul K. Godwin, Jr.; Clifford L. Sadler

[57] ABSTRACT

A spark plug construction employing a non-eroding central electrode iridium tip in combination with a thermal conductor in intimate contact with the tip to act as a heat sink and maintain the tip below 1300° F. (704° C.).

6 Claims, 2 Drawing Figures

SPARK PLUG WITH LOW EROSION ELECTRODE TIP

BACKGROUND OF THE INVENTION

1. Field of the Invention

The present invention is related to the area of spark plugs as used in internal combustion engines and more specifically to improved electrode tip construction for long life spark plugs.

2. Description of the Prior Arts

Several attempts have been made to produce spark plugs having iridium electrodes, since iridium is recognized as being highly resistive to corrosion under extended use. However, due to the fact that iridium is an expensive element, the object of most early work was to provide only an electrode tip exposed to the spark plug gap, rather than build the entire center electrode from iridium.

In U.S. Pat. No. 3,315,113, iridium was mentioned as a substitute center electrode tip material along with tungsten, molybdenum, ruthenium and rhodium for platinum. These materials were mentioned as being superior to platinum in resisting corrosion. However, iridium was mentioned as being very difficult to use as an electrode tip because no appreciable chemical or metallurgical bonding occurred between iridium and the conductive material which formed the remainder of the electrode. The problem was overcome by providing a mechanical bond between the iridium tip and an adjacent part of its associated spark plug center electrode. The technique employed in that patent involved the heating of an intermediate portion of a cylindrical tip element to a predetermined working temperature and then applying a compressive force to opposite ends of the cylinder and form an outwardly extending shoulder section. The tip containing the outwardly extending shoulder section was then placed within the core of a metal sheath and molten silver or copper was used to form a cast core of the sheath between the tip and an upper electrode portion. The core had a high thermal conductivity and was described as forming a relatively weak bond to the tip.

In subsequent U.S. Pat. No. 3,548,237, a technique was discussed which involved shaping of an electrode tip from an iridium rod. The iridium rod was shaped to have a rounded head, which was then welded to the spark gap end of a nickel or nickel alloy cored body portion of the center electrode. This technique was described as being an improvement to the earlier discussed patent by providing a strengthened bond between the tip and the electrode material.

In each of the above prior art patents, methods of assembly involve extensive and expensive steps to reach a completed product. On the other hand, those references fail to acknowledge that iridium has a vaporization temperature below platinum and that if an iridium tip must be kept below its vaporization temperture to perform as a non-eroding electrode tip.

SUMMARY OF THE INVENTION

The present invention is directed to an improved spark plug assembly employing an iridium electrode tip which is highly resistant to erosion over prolonged use. Tungsten, ruthenium and iridium each have erosion rates that are less than platinum for temperatures below 900° F. (482° C.), when subjected to sparks of equal energy. However, above 900° F., tungsten exhibits a dramatic increase in erosion rate as compared to the other materials. Similarly, iridium has a vaporization temperature at approximately 1300° F. (704° C.) and above that temperature its erosion rate exceeds that of platinum. However, due to the fact that iridium is so superior to platinum in resisting erosion, its use as an electrode tip is highly desirable, as long as the temperature of the tip can be kept below 1300° F. (704° C.) for at least 95% of its duty cycle. The present invention achieves that goal by providing the iridium in the form of a circular disc that has one planar surface held in mechanical contact with one end of a highly efficient thermal energy conductor by a central electrode. The central electrode engages a central aperture of the disc to provide electrical connection therewith. The thermal energy conductor is concentric with the center electrode and has its upper end in contact with an electrical conducting material, such as nickel or a nickel alloy, which forms a joint connection between the center electrode and the concentric thermal energy conductor. The center electrode which extends the length of the concentric thermal energy conductor is formed from platinum or an alloy of platinum and has an enlarged head which extends outward from the end of the thermal energy conductor through an aperture in the iridium disc and provides a compressive force to engage the iridium disc with the thermal conductor and also provides an electrical connection between the platinum rod and the iridium disc.

Therefore, it is an object of the present invention to provide an improved spark plug which is highly resistant to errosion and corrosion.

It is another object of the present invention to provide an iridium tipped electrode for an improved spark plug which is easily assembled and provides both a positive electrical connection and thermal sink connection for the iridium tip.

DESCRIPTION OF THE PREFERRED EMBODIMENT

Figure 1:
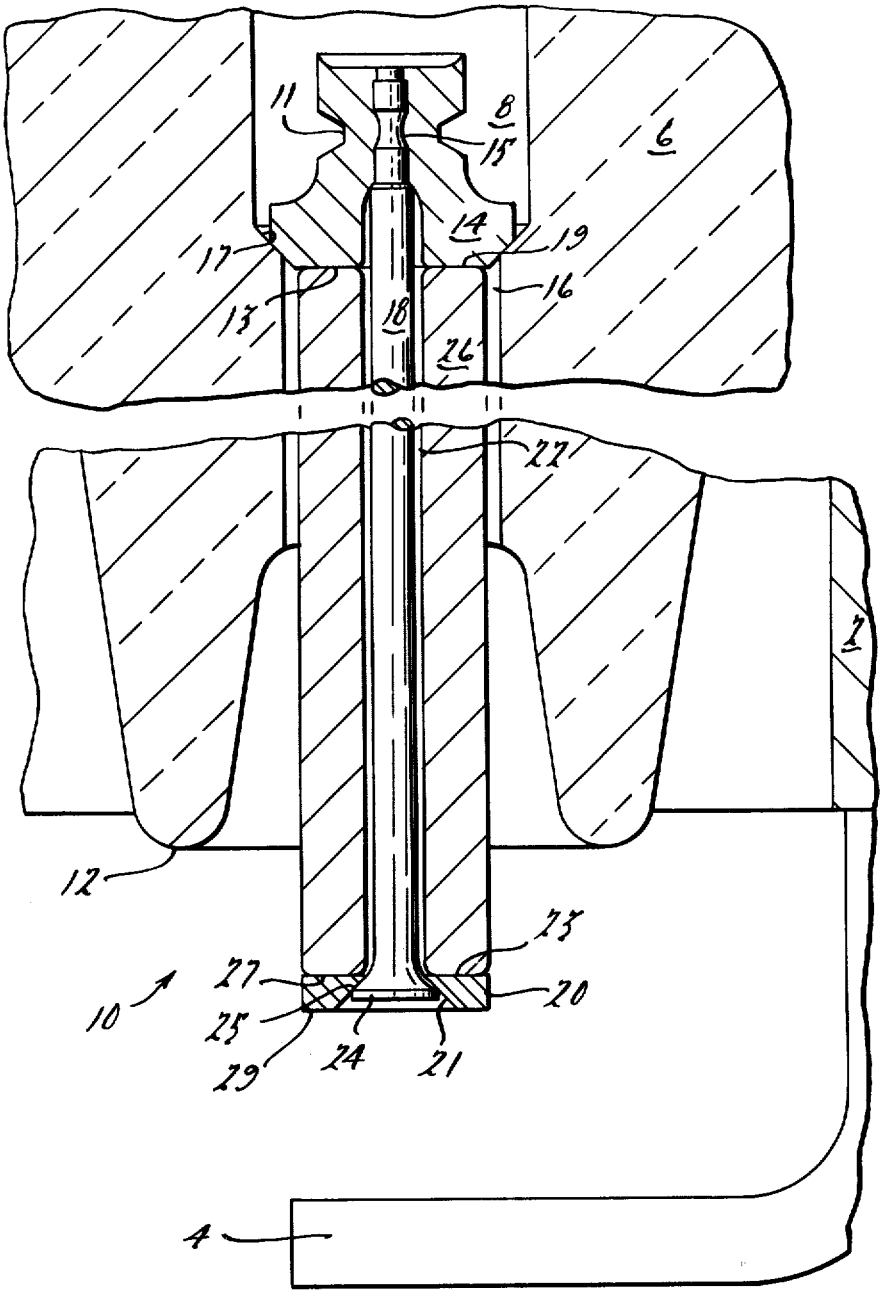
FIG. 1 is a magnified cross-section of a portion of a spark plug which incorporates the present invention.

The improved spark plug electrode assembly 10 is shown as an enlarged cross section in FIG. 1. An outer grounding shell 2 is normally threaded (not shown) to allow for screw-in connection to the cylinder head of an internal combustion engine. A ground electrode 4 extends from the grounding shell 2 and has one end spaced from the center electrode assembly 10 by an amount determined by the particular engine characteristics in which this spark plug assembly is to be employed. A ceramic insulator core 6 is connected to the grounding shell 2 and provides electrical insulation between the center electrode assembly 10 and ground. A central bore 16 extends along the central axis of the insulating core 6 and has a smaller diameter in its lower portion than it does in its upper portion. The two portions are joined by a sloped shoulder 17.

The center electrode assembly 10 includes an iridium disc 20 having an upper surface 23, a lower surface 29 and a frusto-conical aperture 21. The aperture 21 has a larger diameter at surface 29 than its does at surface 23.

An elongated platinum electrode 18 has a lower enlarged end 24 which mates with the upper portion of the frusto-conical aperture 21 in the iridium disc 20. The platinum electrode 18 has an upper end 15 which is crimp connected to a nickel alloy support head 14. The indentation 11 indicates the crimp connection. An electrically insulative-thermally conductive sheath 26 is compressively held between the head 14 and the iridium disc 20 so that its flat lower cylindrical end face 27 abuts and intimately contacts the upper face 23 of the iridium disc 20, thereby providing a low resistance thermal path for heat generated at the iridium disc 20. The upper end 19 of the thermally conductive sheath 26 abuts the head 14 at its lower surface 13 and could provide for a low thermal conductive path therebetween if the head 14 were formed from a good heat conductor. However, the nickel alloy employed in this embodiment is a poor heat conductor and a good electrical conductor.

In this embodiment, the electrically insulative-thermally conductive sheath 26 is constructed from beryllium oxide because it has a high thermal conductivity approximately equal to that of brass and also has a linear coefficient of expansion which is approximately equal to that of the platinum electrode 18. The selection of the two materials, i.e., sheath and electrode, is of critical importance since if the sheat 26 were to have a higher linear thermal coefficient of expansion than that of the electrode 18, the result upon heating would be that the sheath 26 would expand and force the iridium disc 20 outward with respect to the electrode 18 and possibly cause fracturing of the platinum electrode 18 or necking down of the enlarged head 24. Conversely, if the platinum electrode 18 had a higher linear coefficient of expansion than the sheath 26, at elevated temperatures, the iridium disc 20 would have a loose fit between itself and both the sheath and the electrode.

In the embodiment shown in FIG. 1, the electrode assembly 10 including the head 14, sheath 26, electrode 18 and iridium disc 20, is inserted from the upper portion of the central bore 16 until the head 14 engages the shoulder 17. The upper portion of the central bore 16 is then hermetically sealed with a conductive or semi-conductive medium in a conventional manner and a high voltage terminal (not shown) is attached to the top to provide electrical connection between a high voltage supply and the center electrode assembly 10.

Figure 2:
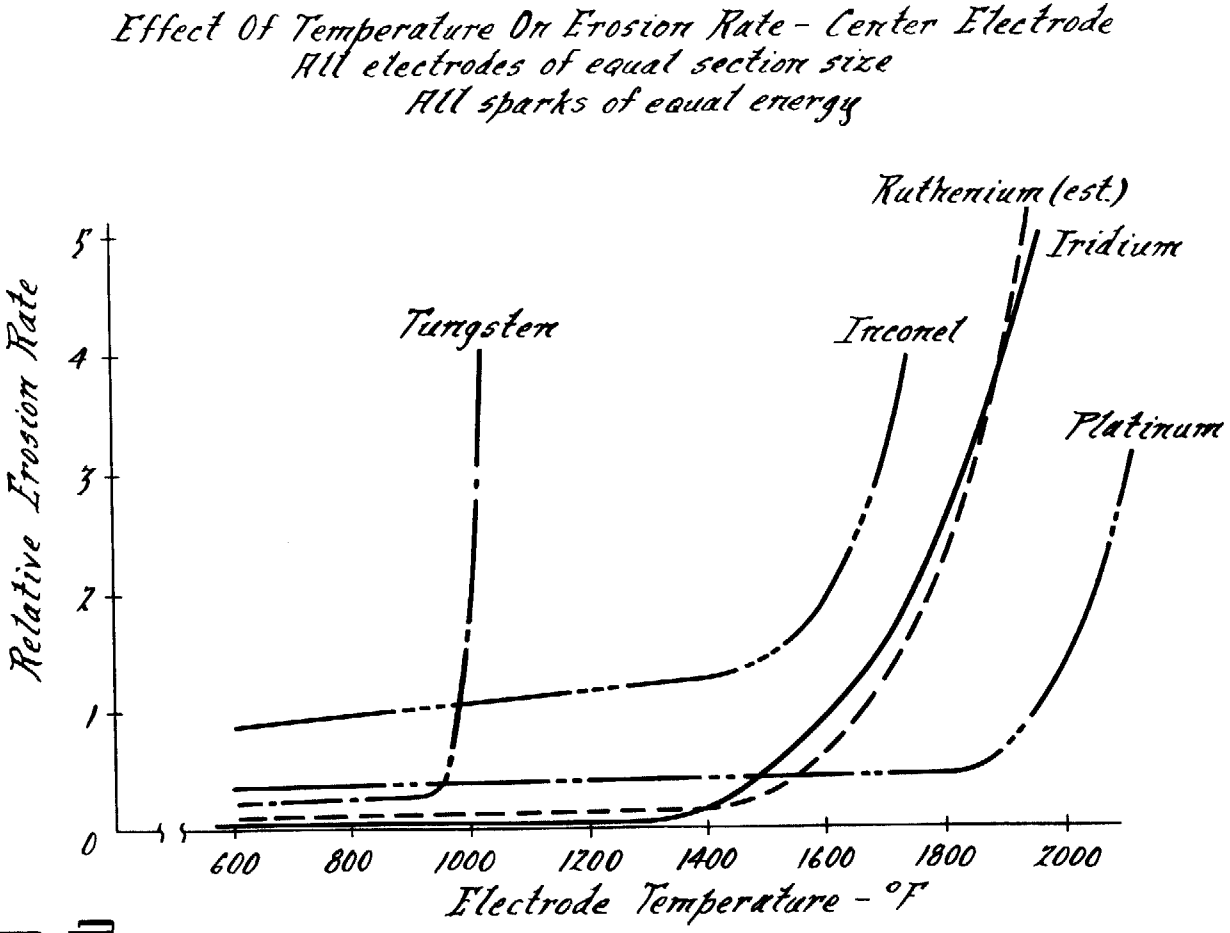
FIG. 2 is a plot of relative errosion rates versus electrode temperatures for various materials used as the center electrode of spark plugs.

By referring to FIG. 2, one can readily see that iridium has negligible erosion rates when used as a center electrode material, up to approximately 1300° F. (704° C.), as compared to ruthenium, tungsten, platinum and inconel. Therefore, the foregoing design shown in FIG. 1 is intended to provide a spark plug center electrode tip having a relatively large surface area exposed to the spark gap and having an even larger surface area contacted for thermal energy dissipation from the tip in order to maintain the tip below 1300° F. On the other hand, the exposed enlarged head portion 24, of the platinum electrode 18, which extends into the aperture 21 of the iridium disc 20 is recessed with respect to the lower surface 29 so that spark energy, taking the path of least resistance, will not effect erosion of the end 24. Finally, the selection of the thermal conductive sheath and the electrically conductive electrode 18 to have near identical linear coefficients of thermal expansion provides for constant electrical and thermal conducting paths between the iridium disc 20 and the upper portion of the center electrode assembly 10.

When the present invention is installed for use in an internal combustion engine, the temperature of the insulator skirt 12 surrounding the electrode assembly 10 may reach as high as 1500° F. (815° C.) so as to burn off any foreign deposits from the insulator. Therefore, a temperature gradient exists between the skirt 12, the ceramic insulator 6, and the grounding shell 2 causing heat dissipation to the cylinder head and ambient atmosphere. At a point along the lower central bore 16 of the ceramic insulator, a positive temperature gradient will exist across the circular air gap between the thermally conductive sheath 26 and the insulator 6 to cause the heat energy to flow across the gap into the insulator 6 for eventual dissipation to the cylinder head and atmosphere. This construction provides a mechanism to maintain the iridium tip below 1300° F. (704° C.) for at least 95% of its duty cycle.

It will be appreciated that many modifications and variations may be effected without departing from the scope of the novel concept of this invention. Therefore, it is intended by the appended claims to cover all such modifications and variations which fall within the true spirit and scope of the invention.

I claim:

1. In a spark plug comprising:

an insulating core having an axial bore therethrough, a center electrode mounted in said bore, an outer grounding shell surrounding said insulating core and a ground electrode electrically connected to said outer shell, an improvement, including:

a thermal energy conducting sheath surrounding said center electrode within said bore; and, an iridium disc in intimate contact with bore said sheath and said center electrode, oppositely positioned across an air gap from said ground electrode, wherein said iridium disc has a frusto-conical aperture with a smaller diameter closest to said center electrode and said center electrode has an enlarged end that extends into said aperture and is larger than said smaller diameter of said aperture to provide an electrical conduction path between said disc and said center electrode.

2. In a spark plug comprising:

an insulating core having an axial bore therethrough, a center electrode mounted in said bore, an outer grounding shell surrounding said insulating core and a ground electrode electrically connected to said outer shell, an improvement, including:

a thermal energy conducting sheath surrounding said center electrode within said bore; and, an iridium disc in intimate contact with both said sheath and said center electrode, oppositely positioned across an air gap from said ground electrode, wherein said center electrode is formed of platinum and said sheath is formed of beryllium oxide.

3. A spark plug as in claim 1, wherein said sheath has a flat end surface coplanar with and abutting one surface of said disc to provide a thermal energy conduction path between said disc and said sheath.

4. A spark plug as in claim 1, wherein said center electrode and said sheath have similar linear coefficients of expansion characteristics at least below 1300° F. (704° C.).

5. A spark plug as in claim 4, wherein said center electrode is formed of platinum and said sheath is formed of beryllium oxide.

6. A spark plug as in claim 5, wherein said sheath has a flat end surface coplanar with and abutting one surface of said disc to provide a thermal energy conduction path between said disc and said sheath.

* * * * *